US005507348A

United States Patent [19]

Van Steenwyk et al.

[11] Patent Number: 5,507,348

[45] Date of Patent: Apr. 16, 1996

[54] APPARATUS FOR LOCKING WIRE LINE INSTRUMENT TO DRILL COLLAR

[75] Inventors: Donald H. Van Steenwyk, San Marino; Raymond W. Teys, Pismo Beach, both of Calif.; Robert M. Baker, The Woodlands, Tex.

[73] Assignee: Scientific Drilling International, Houston, Tex.

[21] Appl. No.: 341,132

[22] Filed: Nov. 16, 1994

[51] Int. Cl.[6] ..... E21B 23/01

[52] U.S. Cl. ..... 166/382; 166/117.6; 166/162; 166/241.5

[58] Field of Search ..... 166/382, 381, 166/117, 117.5, 117.6, 162, 241.5, 243

[56] References Cited

U.S. PATENT DOCUMENTS

| | | | |
|---|---|---|---|
| 1,816,856 | 8/1931 | Kinzbach et al. | 166/117.6 |
| 2,679,903 | 6/1954 | McGowen, Jr. et al. | 166/382 X |
| 3,800,871 | 4/1974 | Watson et al. | 166/382 X |
| 3,825,285 | 7/1974 | McArthur et al. | 166/382 X |
| 4,373,584 | 2/1983 | Silberman et al. | 166/382 X |
| 4,440,222 | 4/1984 | Pullin | 166/117.5 |
| 4,727,939 | 3/1988 | Airey | 166/162 |
| 5,335,737 | 8/1994 | Baugh | 166/117.6 X |

*Primary Examiner*—Frank s. Tsay
*Attorney, Agent, or Firm*—William W. Haefliger

[57] ABSTRACT

An apparatus for supporting instrumentation in a drill collar in a well, such instrumentation being subject to travel in the well to and from the drill collar comprising instrumentation having upper and lower end portions and being elongated between the end portions; there being tongue and groove interfit elements to suspend the instrumentation at the drill collar; one of the elements carried by the drill collar, and the other of the elements carried by the upper portion of the instrumentation, whereby the elements interfit as the instrumentation is traveled downwardly in the drill collar with the instrumentation lower portion hanging freely below the level of the elements.

18 Claims, 5 Drawing Sheets

100
51
10
11
51
10
20
14
60

100
51
10
11
51
20
60
14

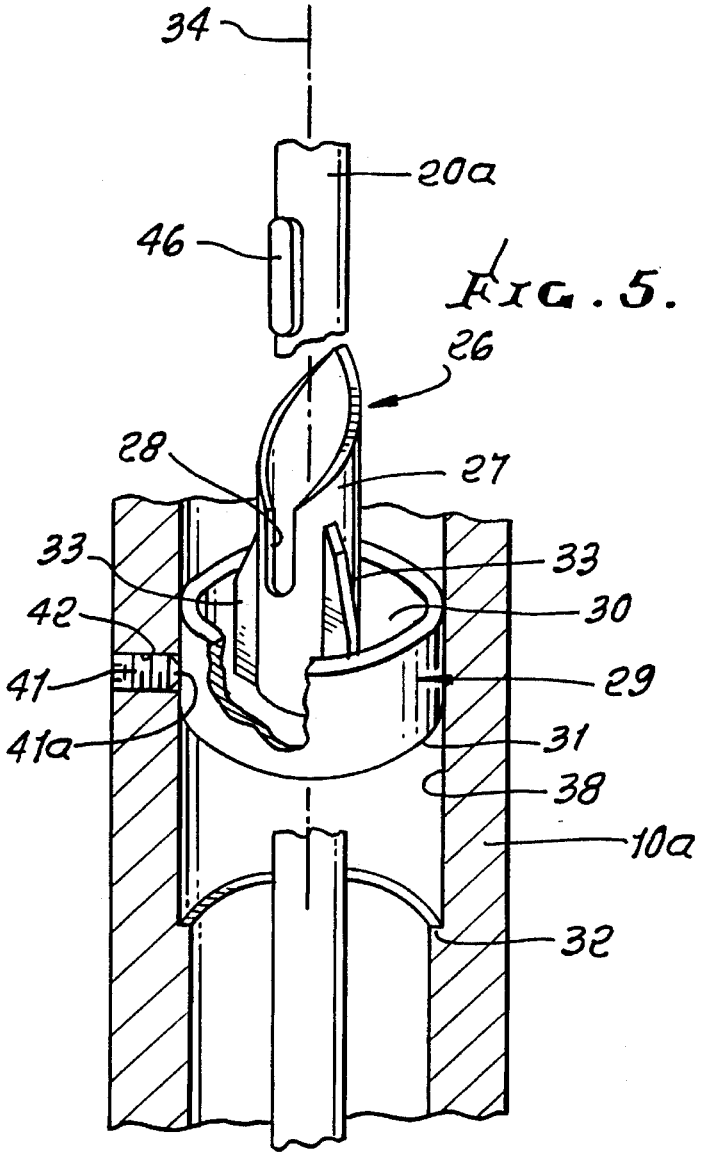
FIG. 5.
FIG. 6.
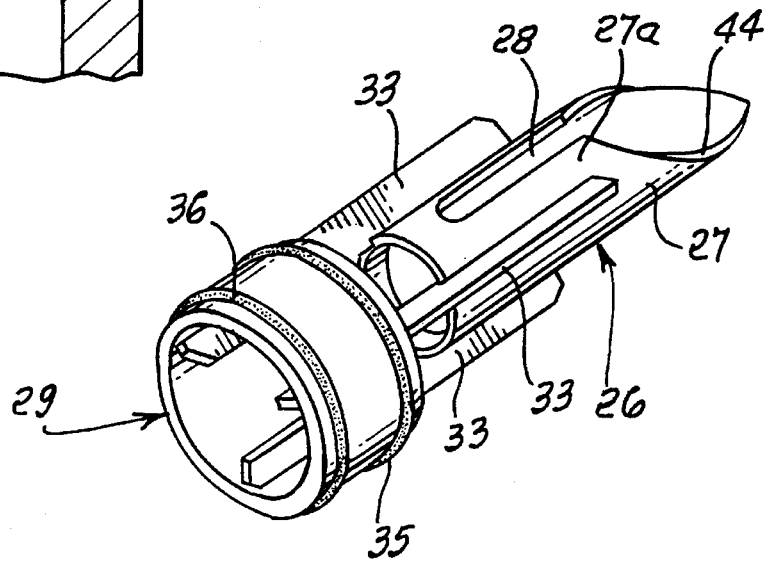

APPARATUS FOR LOCKING WIRE LINE INSTRUMENT TO DRILL COLLAR

BACKGROUND OF THE INVENTION

This invention relates generally to the support of instrument packages in a well; and more particularly, the support of well survey packages to eliminate or reduce vibration and buckling of such packages.

Well survey instruments run in wells are typically very narrow and quite long; for example, they are commonly less than two inches in overall diameter, and at least six feet long. It has been the practice to land such instruments in drill collars near the drill bit, employed in directional drilling a well. Drilling mud flowing downwardly past the long, slender instrument package, supported near its lowermost extent, exerts loading, tending to buckle the package; also, variations in such loading tend to induce flutter in the long, slender package. These conditions are detrimental to use and performance of the instrumentation.

There is, accordingly, need for improvements, which reduce or eliminate such problems.

SUMMARY OF THE INVENTION

It is a major object of the invention to provide improved apparatus and method meeting the above need or needs. Basically, the improved apparatus for landing and supporting well survey instrumentation in a drill collar in a well comprises:

i) tongue and groove interfit elements to suspend the instrument package at the drill collar, ii) one of the elements carried by the drill collar, and the other of the elements carried by the upper portion of the instrumentation, whereby the elements interfit as the instrumentation is traveled downwardly in the drill collar with the instrumentation lower portion hanging freely below the level of the interfit elements.

As referred to, the instrument package typically includes an elongated tubular housing having an overall length in excess of six feet, and a diameter or diameters less than about two inches; the one element comprises a mule shoe having an upright, tubular body with a wall forming an upright slot which opens upwardly, and the other element comprises a lug projecting sidewardly from the instrumentation housing and sized for downward reception into the slot, as the instrumentation is lowered in the well.

It is another object to provide a sleeve attached to the mule shoe and forming mud flow passages between the sleeve and shoe, the sleeve having a downward-facing shoulder located to be supported by a ledge formed by the drill collar. Elastomeric seals may be provided on the sleeve to sealingly engage a bore defined by the drill collar; and such seals may comprise two vertically spaced O-rings extending about the sleeve, there being a retainer fastener carried by the collar and sidewardly engaging the sleeve at a location between the O-rings.

A further object is to provide vertically extending webs spaced about an axis defined by the collar and integral with the sleeve and the mule shoe to centrally position the mule shoe in the collar, the space between the webs sized to freely pass drilling mud flowing downwardly in the well.

Yet another object is to provide cam surfaces on the mule shoe to be slidably engaged by the lug and to direct the lug into the slot upon lowering of the instrumentation in the well.

Flutter of the suspended instrument package is substantially eliminated by provision of centering means carried by the collar below the level of the interfit elements; and such centering means may advantageously comprise elastomeric structure comprising multiple elastomeric pads spaced about a longitudinal axis defined by the instrumentation.

As will be seen, the pads typically extend generally longitudinally, and protrude in directions radially of the axis to absorb radial loading, as well as bending loading created by lengthwise bending of the drill collar during drilling. The pads may have close, guiding sideward fit to the instrument package to block sideward vibration of the instrumentation in response to mudflow past and in engagement with the instrumentation.

These and other objects and advantages of the invention, as well as the details of an illustrative embodiment, will be more fully understood from the following specification and drawings, in which:

DRAWING DESCRIPTION

FIG. 5 is an axial exploded view of elements of the instrument package suspension; and FIG. 6 is a perspective view of an interconnected sleeve and mule shoe employed to suspend the instrument package.

DETAILED DESCRIPTION

Figure 1:
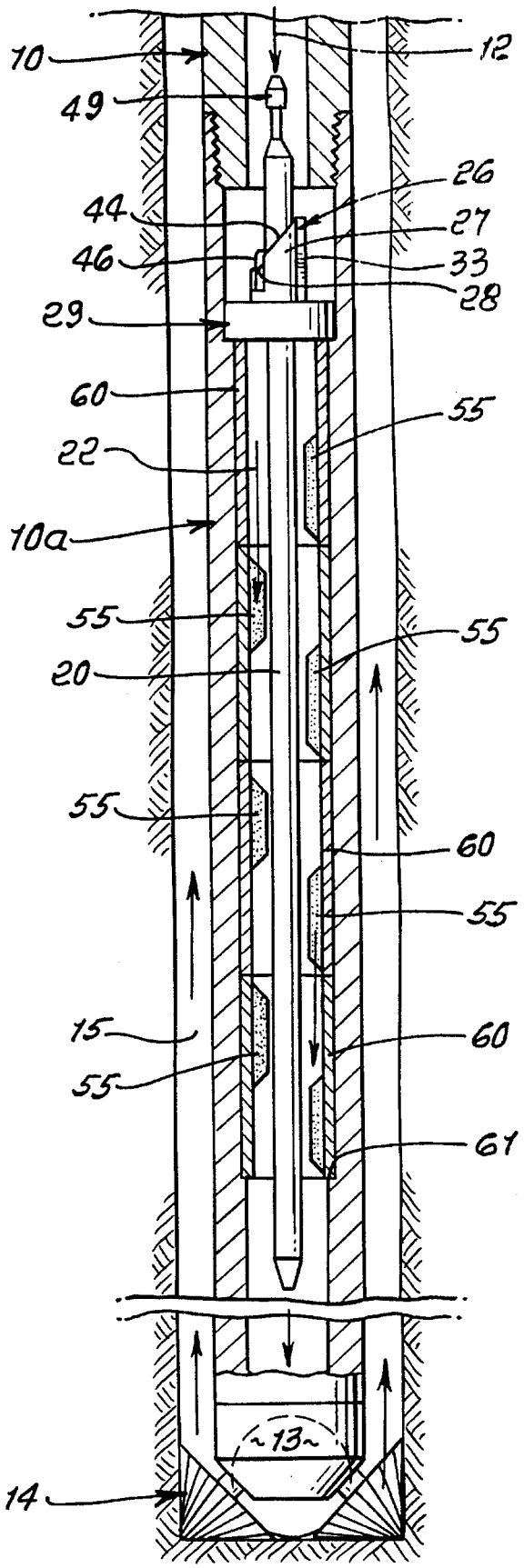
FIG. 1 is a vertical elevation showing an instrument package suspended in a well.
Figure 2:
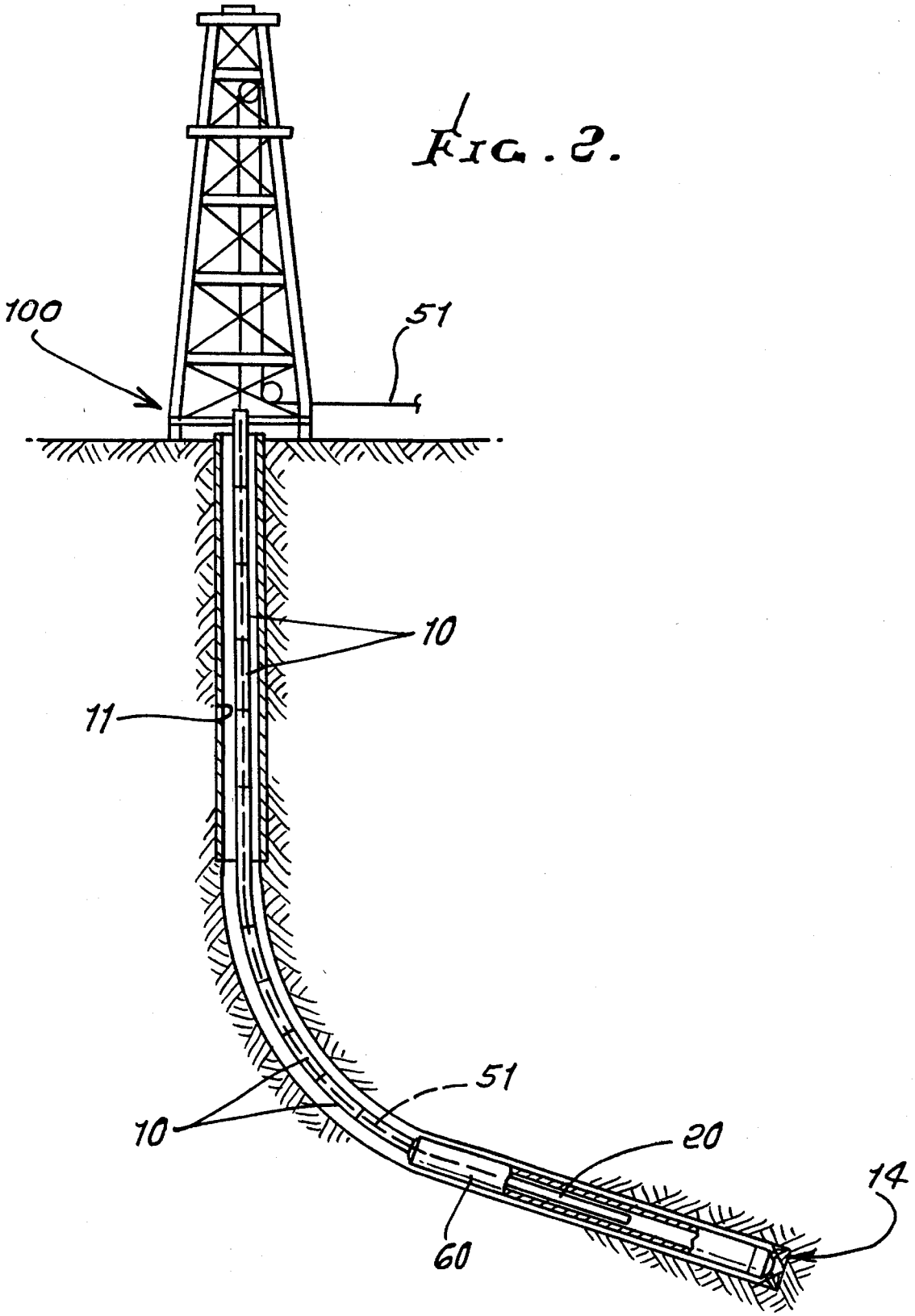
FIG. 2 is a vertical section showing a deviated bore hole, drill string and drill collar, receiving the suspended instrument package in accordance with the invention.
Figure 3:
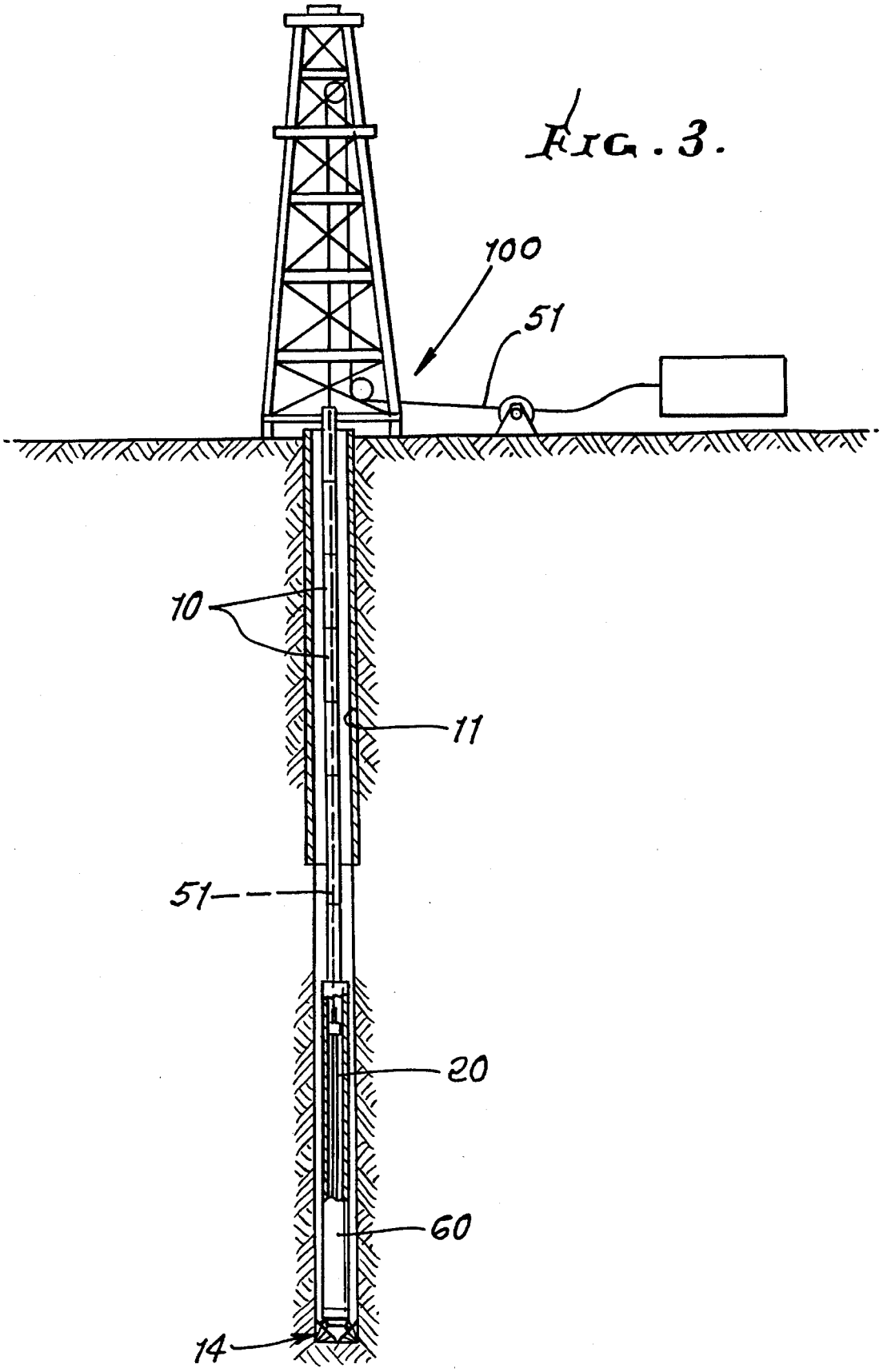
FIG. 3 is a view like FIG. 2 but showing the instrument package and drill collar in a vertical well environment.

Referring first to FIGS. 1 and 2, a drill string 10 is shown in a well 11, with drilling mud circulating downwardly at 12. Such mud travels to the mud motor 13, effecting its operation to rotate and drill bit 14, which drills the well downwardly. Elements 13 and 14 are schematically shown.

Drill cuttings are carried upwardly by the circulating mud flowing upwardly in the annulus 15 between the well bore and the string, as is well known. The mud and cuttings flow to the surface for separation of cuttings and return of mud to the string.

As the motor and drill bit cuts against the underground formation, there is axial and sideward shock loading and rotary shock loading, all transmitted to the lower end of the string, as to pipe or collar 10*a* causing the pipe or collar to move axially up and down, and sidewardly back and forth, and to move rotatably back and forth about the pipe axis, such movements constituting vibration in multiple modes.

A well survey instrument 20 is shown lowered in the hole, by line 51, to the location, as shown, within the drill pipe. One example is a magnetic survey tool, such tool being well known. FIG. 2 shows the hole 11 deviated to near horizontal, the well head indicated at 100. In order that such instrument may operate to best advantage, its substantial isolation from vibration induced by mud flow past the instrument, and from the multi-mode vibrating motion of the drill pipe 10 is sought, in accordance with the invention. This is particularly desirable when the instrument 20 is very narrow (say one inch to one and one-half inch in diameter), since it is subjected to bending and flutter, disturbing its operation. Also, buckling of the instrument is to be prevented.

Figure 4:
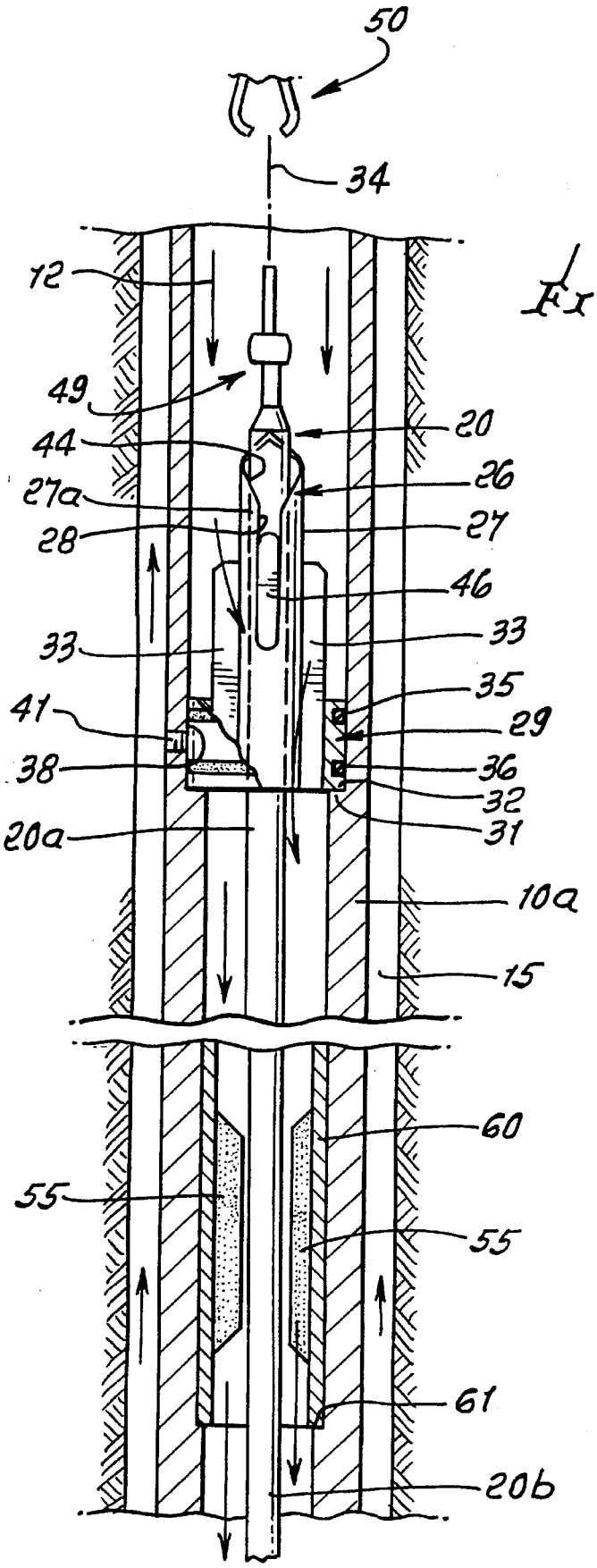
FIG. 4 is an enlarged vertical section showing details of the instrument package suspension, in a drill collar in a well.

Referring to FIG. 4, the elongated instrument 20 is shown as suspended in the well, as within drill collar 10*a*, the instrument having an upper end portion 20*a*, which is suspended, and a lower end extent 20*b* freely hanging in the collar or string, so as to be free of tendency to buckle. Typical length of the instrument housing is between eight feet and twelve feet; and typical housing overall diameter or diameters is between about 1⅜ inches and 1¾ inches. Housing wall thickness is typically between 0.155 and 0.175 inches, whereby that thin shell wall would be subject to buckling if the instrument were supported at or near its lower end, and under normal mud flow conditions, characterized by substantial downward frictional force exertion on the housing wall outer surface. See flow arrows 22 in FIGS. 1 and 4.

Tongue and groove interfit elements are provided to suspend the instrument at the drill collar. One of such elements is carried by the drill collar, and the other of the elements carried by the upper portion of the instrumentation, whereby the elements interfit as the instrumentation is traveled downwardly in the drill collar with the instrumentation lower portion hanging freely below the level of the elements, preventing buckling.

As shown in FIG. 4, the one element comprises a mule shoe 26 having an upright, tubular body 27 with a wall 27*a* forming an upright, elongated slot 28. The slot opens upwardly to downwardly receive the other element, which comprises a vertically elongated lug 46 projecting sidewardly from the instrument housing upper portion 20*a*. The slot is sized for close reception of the lug as the instrument 20 is lowered into the drill collar in the well and through the open-ended mule shoe.

A metallic support sleeve 29 is attached to the mule shoe, so that mud flow passages are formed between the shoe and sleeve, as at 30. The sleeve has a downward facing annular shoulder 31 located to be supported by an annular ledge 32 formed by the collar. Vertically extending webs 33 are spaced about the axis 34 defined by the collar and are integral with the sleeve and the mule shoe to centrally position the mule shoe in said collar, the space between the webs sized to freely pass drilling mud flowing downwardly in the well.

Annular elastomeric seal means is provided on the sleeve to sealingly engage a bore defined by the collar. That seal means typically includes two vertically spaced annular O-rings 35 and 36 extending about the sleeve, in shallow grooves in the sleeve, to engage and seal against bore 38 of the collar. A retainer fastener, such as a set screw 41, is carried by the collar, as in an opening 42 in the collar wall and has threaded connection, to the collar wall to be tightened from the exterior. The end 41*a* of the fastener is thereby tightly engaged against the sleeve outer surface, between the two O-rings, to position the sleeve. Corrosion and erosion of the fastener are prevented by its isolation from the mud flow effected by the sealing O-rings. FIGS. 1 and 5 show a sleeve without O-rings.

Downward spiralling cam surfaces 44 are provided on the upper end of the mule shoe tube to act as guides for the lug 46, to direct the lug into the slot 28, with corresponding rotation of the instrument 20, as it is traveled downwardly in the collar. A fishing neck 49 on the instrument package 20 is grasped by a tool 50 to lower the package 20. That neck is also grasped by the tool for raising or retrieving the instrument, via line 51, extending to a drum 52 at the well head.

Also provided is centering means for the instrument 20, below the level of the tongue and groove elements, as referred to above. That centering means typically includes elastomeric structure comprising multiple elastomeric pads spaced about a longitudinal axis defined by said instrumentation. Such pads 55 extend generally longitudinally and protrude from the collar radially inwardly toward axis 34 to absorb radial loading, as well as torsional loading, and bending loading created by lengthwise bending of the drill collar during drilling.

The pads, therefore, provide sideward and torsional cushioning of the instrument housing, blocking or dampening sideward and torsional flutter that can otherwise be induced by collar movement and/or by mud flow past the instrument housing as mud flows past the housing in engagement therewith, and between the circularly spaced pads 55, which are typically attached to one or more tubular carriers 60 in the collar. Collar 60 may stack, as shown in FIG. 1. A ledge 61 in the collar supports the carrier. Multiple sets of such pads may be provided, each set at a different level in the carrier, and the pads may be staggered, vertically, and may extend in spiral or other configuration, while extending into proximity to the instrument outer wall.

Accordingly, damage to the instrumentation 20 and to circuitry therein is prevented. Typical instruments 20 include magnetic survey tools known as EYE-II made by Applied Navigation Devices, Paso Robles, Calif., and FINDER & KEEPER bore orientation tools produced by that company. Other instruments are also usable.

A further advantage of the invention is the achieved relaxation of stresses on the instrument package 20, normal to directional drilling a bore hole. The instrument package is not "curved" as severely as the drill string itself, due to cushioning afforded by the pads 55; yet, the instrument package maintains an average centered position within the cushioning system, permitting string "dog-legs" more severe that normally would be tolerated.

We claim:

1. An apparatus for supporting instrumentation in a drill collar in a well, such instrumentation being subject to travel lengthwise in the well to and from the drill collar, the combination comprising a) said instrumentation having upper and lower end portions and being elongated between said end portions, b) tongue and groove interfit elements to suspend the instrumentation within the drill collar, c) one of said elements carried by the drill collar, and the other of said elements carried by the upper portion of the instrumentation, whereby said elements interfit as said instrumentation travels downwardly in the drill collar with said instrumentation lower portion hanging freely below said elements.

2. The combination of claim 1 including instrumentation centering means carried by said collar below said elements.

3. The combination of claim 2 wherein said centering means includes elastomeric structure comprising multiple elastomeric pads spaced about a longitudinal axis defined by said instrumentation.

4. The combination of claim 3 wherein said pads extend generally longitudinally, and protrude in directions radially of said axis to absorb radial loading, as well as bending loading created by lengthwise bending of the drill collar during drilling.

5. The combination of claim 1 wherein said instrumentation includes an elongated tubular housing having an overall length in excess of six feet and a diameter or diameters less than two inches.

6. The combination of claim 5 wherein said one element comprises a mule shoe having an upright wall forming an upright slot which opens upwardly, and said other element comprises a lug projecting sidewardly from said instrumentation housing and sized for downward reception into said slot, as said instrumentation is lowered in the well.

7. The combination of claim 6 including a sleeve attached to said mule shoe and forming mud flow passages between the sleeve and shoe, said sleeve having a downward-facing shoulder located to be supported by a ledge formed by the drill collar.

8. The combination of claim 7 including annular elastomeric seal means on said sleeve to sealingly engage the annular bore between the collar and the sleeve.

9. The combination of claim 8 wherein said seal means includes two vertically spaced O-rings extending about the sleeve, there being a retainer fastener carried by said collar and sidewardly engaging said sleeve at a location between said O-rings.

10. The combination of claim 7 wherein the collar has an axis, and including vertically extending webs spaced about said axis and integrated with the sleeve and the mule shoe to centrally position the mule shoe in said collar, the space between the webs sized to freely pass drilling mud flowing downwardly in the well.

11. The combination of claim 6 including cam surfaces on said mule shoe to be slidably engaged by the lug and to direct the lug into the slot upon lowering of said instrumentation in the well.

12. The combination of claim 9 including said drill collar having a ledge which lands the sleeve.

13. The combination of claim 3 wherein said elastomeric pads are elongated lengthwise of the collar and spaced about said axis to pass drilling mud between the pads.

14. The combination of claim 13 wherein said pads extend sidewardly of said instrumentation to block sideward vibration of said instrumentation in response to mud flow adjacent said instrumentation.

15. The combination of claim 13 wherein there are at least three of said pads spaced about said axis.

16. The combination of claim 1 wherein said instrumentation includes well survey circuitry.

17. In the method of supporting instrumentation in a well, such instrumentation including an elongated, narrow housing past which drilling mud flows downwardly, the steps that include a) traveling said instrumentation downwardly in the well to a selected location, via a wire line, providing cushioning means in the well at said location, b) supporting said instrumentation in the well at said location and independently of said wire line, whereby the major length of the housing hangs freely in the well, and the housing also extending sidewardly adjacent said cushioning means, c) and causing drilling mud to flow downwardly in the well and adjacent said housing.

18. The method of claim 17 including providing a tubular drill collar in the well, providing a tubular mule shoe in the drill collar, said housing having a major extent, and landing said instrumentation at said mule shoe to hang said major extent of the housing freely below said mule shoe.

* * * * *